US008544149B1

(12) United States Patent
Faber

(10) Patent No.: US 8,544,149 B1
(45) Date of Patent: Oct. 1, 2013

(54) GATE STABILIZER

(76) Inventor: Eric Brett Faber, Lexington, KY (US)

( * ) Notice: Subject to any disclaimer, the term of this patent is extended or adjusted under 35 U.S.C. 154(b) by 445 days.

(21) Appl. No.: 12/862,272

(22) Filed: Aug. 24, 2010

Related U.S. Application Data

(63) Continuation-in-part of application No. 12/394,851, filed on Feb. 27, 2009, now abandoned, which is a continuation-in-part of application No. 11/680,251, filed on Feb. 28, 2007, now abandoned.

(51) Int. Cl.
*E05D 7/12* (2006.01)

(52) U.S. Cl.
USPC ..... 16/256; 16/88; 292/DIG. 29

(58) Field of Classification Search
USPC ..... 16/86.1, 88; 292/DIG. 29
See application file for complete search history.

(56) References Cited

U.S. PATENT DOCUMENTS

| | | | | |
|---|---|---|---|---|
| 379,660 | A | | 3/1888 | Price |
| 1,570,734 | A | | 12/1923 | Eversman |
| 2,021,549 | A | | 11/1935 | Harris |
| 2,566,771 | A | | 9/1951 | Limpo et al. |
| 2,758,863 | A | | 8/1956 | Waymire et al. |
| 2,777,227 | A | | 1/1957 | Imhoff |
| 2,823,942 | A | | 2/1958 | Bichel |
| 2,973,595 | A | | 3/1961 | Lamphier |
| 3,647,250 | A | | 3/1972 | Brown |
| 3,697,106 | A | | 10/1972 | Meyer |
| 3,751,084 | A | | 8/1973 | Lening |
| 4,940,265 | A | | 7/1990 | Weigel |
| 5,098,140 | A | * | 3/1992 | Kentner ..... 292/247 |
| 5,167,049 | A | | 12/1992 | Gibbs |
| 6,406,003 | B1 | | 6/2002 | Shaw |
| 6,703,396 | B1 | | 3/2004 | Liotta et al. |
| 2006/0038416 | A1 | | 2/2006 | Nesseth |
| 2008/0222842 | A1 | | 9/2008 | Faber |

* cited by examiner

*Primary Examiner* — Carlos Lugo
*Assistant Examiner* — Mark Williams
(74) *Attorney, Agent, or Firm* — Wyatt, Tarrant & Combs, LLP; Matthew A. Williams

(57) ABSTRACT

A gate stabilizer for reducing sag-inducing stress on a gate comprising a support member and a stabilizer assembly, said stabilizer assembly including a rotating member having a first end portion adapted to engage said support member and a fixed member. The present invention further relates to a fence system incorporating said gate stabilizer.

10 Claims, 10 Drawing Sheets

GATE STABILIZER

CROSS REFERENCE TO RELATED APPLICATIONS

This application is a continuation-in-part of U.S. patent application Ser. No. 12/394,851 that was filed on Feb. 27, 2009, now abandoned which is hereby incorporated by reference and which was a continuation-in-part of now abandoned U.S. patent application Ser. No. 11/680,251 that was filed on Feb. 28, 2007 and entitled "Gate Stabilizer," which is hereby incorporated by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention generally relates to fence gates. More specifically, the invention is a gate stabilizer intended to eliminate gate sag, reduce the stress on gate hinges, and prevent a gate from being forced open.

2. General Background of the Invention

Gate systems, and particularly livestock gates that are usually heavier and larger than normal fence gates, in which the gate hangs on hinges attached to a gate post but is not otherwise supported are plagued by a unique set of problems. One problem routinely experienced by users of these gates is the tendency of gates to sag in at least two non-exclusive manners. First, the sag may result from the failure of the gate structure itself. Second, the otherwise unsupported weight of the gate can cause the gate post to bend or tilt.

The first failure is caused by the fact that the gate is only supported at one end by the hinges that are attached to the gate post. This results in the weight of the gate applying forces to the internal structure of the gate that can result in failure over time.

The second failure is caused by the force couple the weight of the gate applies to the gate post through the hinges. Since the opposing end of the gate is unsupported, the weight of the gate acts to pull the upper hinge, and therefore the upper portion of the gate post, toward the gate. Simultaneously, the weight of the gate acts to push the lower hinge, and therefore the lower portion of the gate post, away from the gate. Over time, this can cause the fence post to bend or to tilt relative to its original positioning thereby causing the gate to sag.

Prior solutions to this problem have tended to create additional problems. For example, the free end of the gate can be supported by a wheel, but this makes the gate difficult to operate as it does not swing freely, especially when the gate is installed over uneven ground or gravel. Other solutions have focused on devices that increase stress on the hinges by employing tactics such as tensioning a gate to a gate post. Other approaches to resolving this problem result in a weakening of the gate structure as a whole by reducing the strength or weight of the gate itself. Alternatively, other methods rely on hinges of increased strength to attempt to counterbalance the stress of the gate.

In summary, no real effort has been made to remedy the cause of gate sag by reducing the stress applied to the hinges and the structure of the gate. Instead, known devices and methods either attempt to compensate for the problem of gate sag once it has occurred or create added stress on the gate and hinges that eventually results in gate sag.

Another problem faced by typical gate structures is that the unsupported gate latches only at the middle to upper portion of the gate. This makes the gate susceptible to being forced open at the lower portion by an animal or child being contained or excluded in part by the gate. This typical structure also results in a gate system that is susceptible to vibration and movement that may cause injury to livestock.

It is also a known problem of fencing systems that the horizontal distance between a gate in its closed position and the post to which the gate is to be secured can vary greatly due to a number of factors, including how far out of plumb the post is, how far out of plumb the gate is, and the accuracy of the installer in setting the gate posts. Accordingly, installers frequently have difficulty in installing latches and similar devices on gates that must be connectable to a mating device affixed to the post to which the gate must be secured.

The object of this invention then is address the above identified problems by providing an apparatus that can is inexpensive and easy to apply to both gate systems that are already in service and new gate systems regardless of what side the gate is hinged on. In addition to reducing the stress on the gate and the gate post, the present invention is livestock proof, meaning that it cannot be opened by the nose, shoulder, or hoof of animals such as cows, horses, pigs, sheep, and goats.

SUMMARY OF THE INVENTION

The present invention relates to an apparatus for reducing sag-inducing stress on a gate comprising a support member and a stabilizer assembly, said stabilizer assembly including a rotating member having a first end portion adapted to engage said support member and a fixed member. The present invention further relates to methods for using said apparatus.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
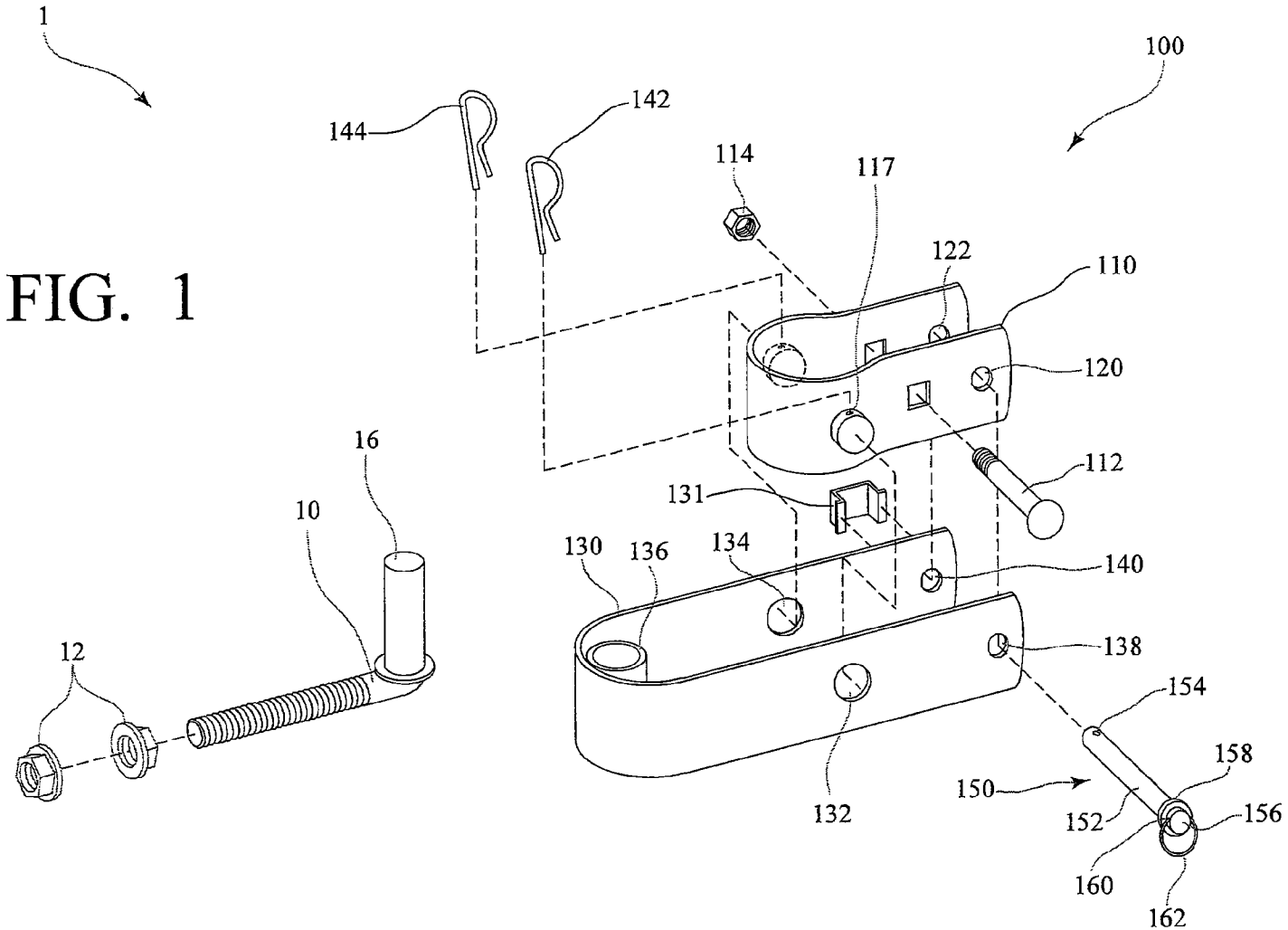
FIG. 1 is an exploded, perspective view of an embodiment of the present invention.
Figure 2:
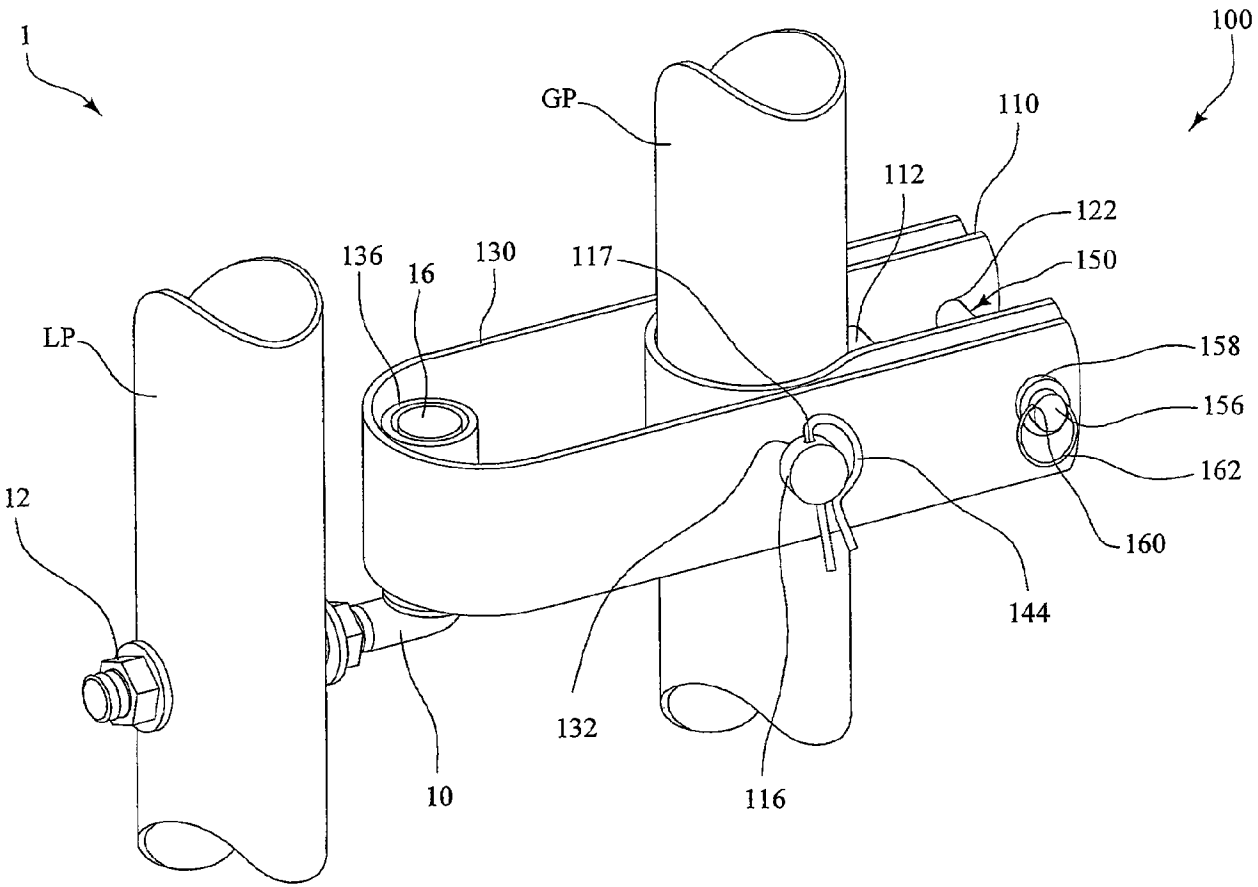
FIG. 2 is a perspective view of the embodiment of the present invention from FIG. 1 as mounted on a gate and latch post.

FIG. 1 shows an embodiment of the present invention—gate stabilizer 1 formed from galvanized steel. In the embodiment shown in FIG. 1, gate stabilizer 1 includes L-shaped support member 10 and stabilizer assembly 100. In the illustrated embodiment, support member 10 is sized to pass through latch post LP as best seen in FIG. 2. Support member 10 is affixed to latch post LP using nuts 12. Support member 10 includes upstanding cylindrical portion 16.

Figure 3:
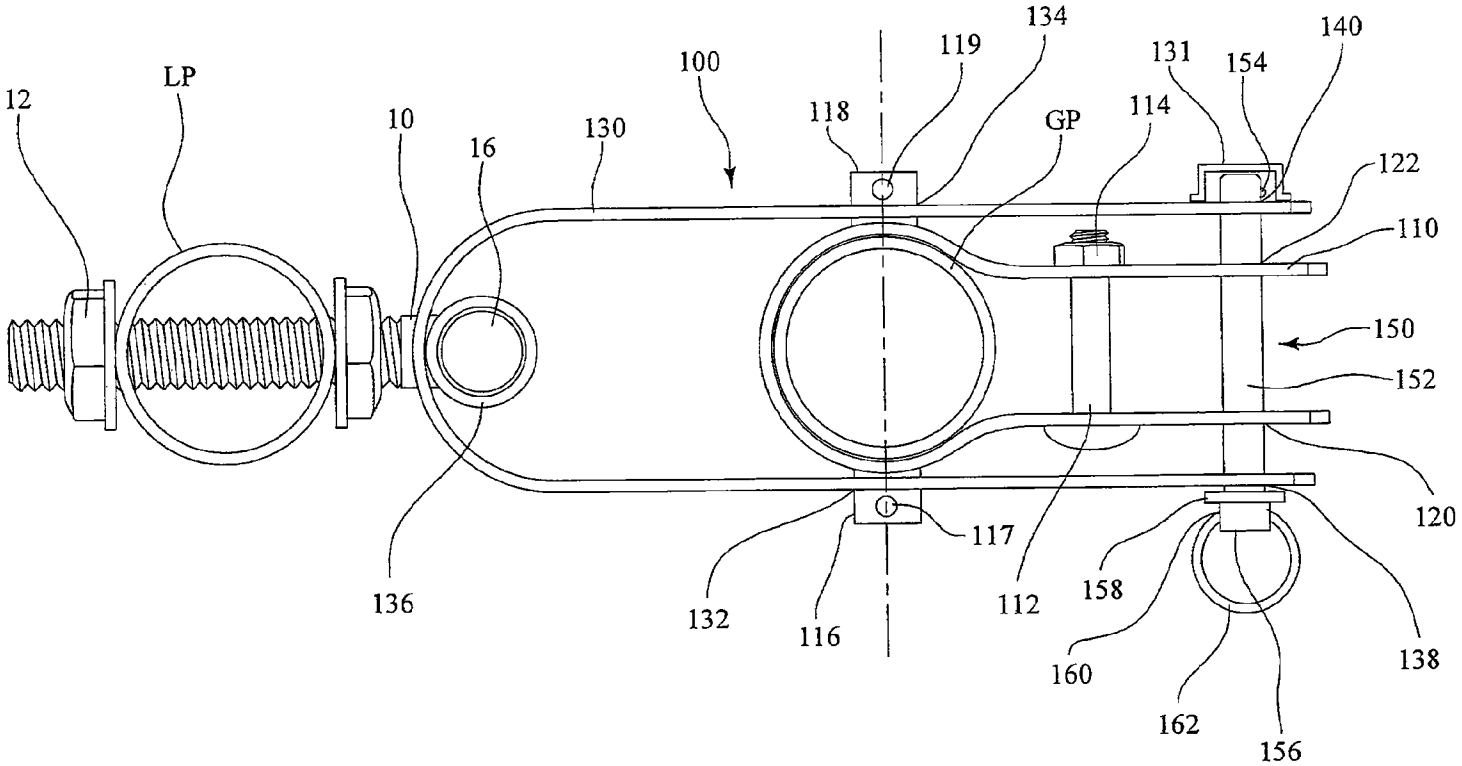
FIG. 3 is a top elevation view of the embodiment of the present invention from FIG. 1.

Still referring to FIG. 1, stabilizer assembly 100 includes fixed member 110. In the embodiment shown in FIG. 1, fixed member 110 is a generally U-shaped member adapted to wrap around the gate post GP as best seen in FIG. 3. In the illustrated embodiment, fixed member 110 is attached to gate post GP by compressing fixed member 110 around gate post GP using bolt 112 and nut 114 (best seen in FIG. 3). Of course other methods of attaching fixed member 110 may be used including, but not limited to, bolting it directly to gate post GP or welding it directly to gate post GP. Fixed member 110 further includes cylindrical projections 116 and 118 (best seen in FIG. 3) extending from its sides along the centerline of gatepost GP. And the end portion of fixed member 110 is adapted to receive coupling pin 150 through the inclusion of a pair of coupling apertures 120 and 122 that coupling pin 150 can pass through.

Still referring to FIG. 1, stabilizer assembly 100 further includes rotating member 130. In the illustrated embodiment, rotating member 130 is a generally U-shaped member that includes a pair of rotational apertures 132 and 134 located opposite each other at the midpoint of its length. Rotational apertures 132 and 134 are sized to receive cylindrical projections 116 and 118, allowing rotating member 130 to rotate about cylindrical projections 116 and 118. The end portion of rotating member 130 including the closed portion of the "U" is adapted to engage support member 10. In the illustrated embodiment, this adaptation comprises tubular member 136, which is permanently affixed to the inner surface of rotating member 130 and sized to receive cylindrical member 16 of support member 10. The opposing end portion of rotating member 130 is adapted to receive coupling pin 150 through the inclusion of a pair of coupling apertures 138 and 140.

Still referring to FIG. 1, cylindrical projections 116 and 118 include holes 117 and 119 (best seen in FIG. 3) located in the end portion of each projection opposite fixed member 110. In the illustrated embodiment, spring-type cotter pins 142 and 144 pass through holes 117 and 119 respectively to hold rotating member 130 in place.

Still referring to FIGS. 1 and 2, coupling pin 150 includes a cylindrical shaft 152 sized to pass through coupling apertures 120, 122, 138, and 140. Spring-loaded ball-bearing 154 is located toward one end of cylindrical shaft 152 to prevent coupling pin 150 from being inadvertently removed. Cap 156 is mounted at the opposing end of cylindrical shaft 152. Cap 156 includes flange 158 that is larger in diameter than coupling aperture 138. Cap 152 further includes opening 160 through which wire ring 162 passes. Shroud 131 is attached to rotating member 130 such that it shields the end of coupling pin 150 toward which spring-loaded ball-bearing 154 is located to prevent livestock from being able to inadvertently dislodging coupling pin 150. While shroud 131 is shown as being rectangular and open at the top and bottom, shroud 131 can take on any shape that prevents an animal from contacting the end of coupling pin 150. For example, instead of being open at the top, the top of shroud 131 could be connected to rotating member 130 at an angle.

Figure 4:
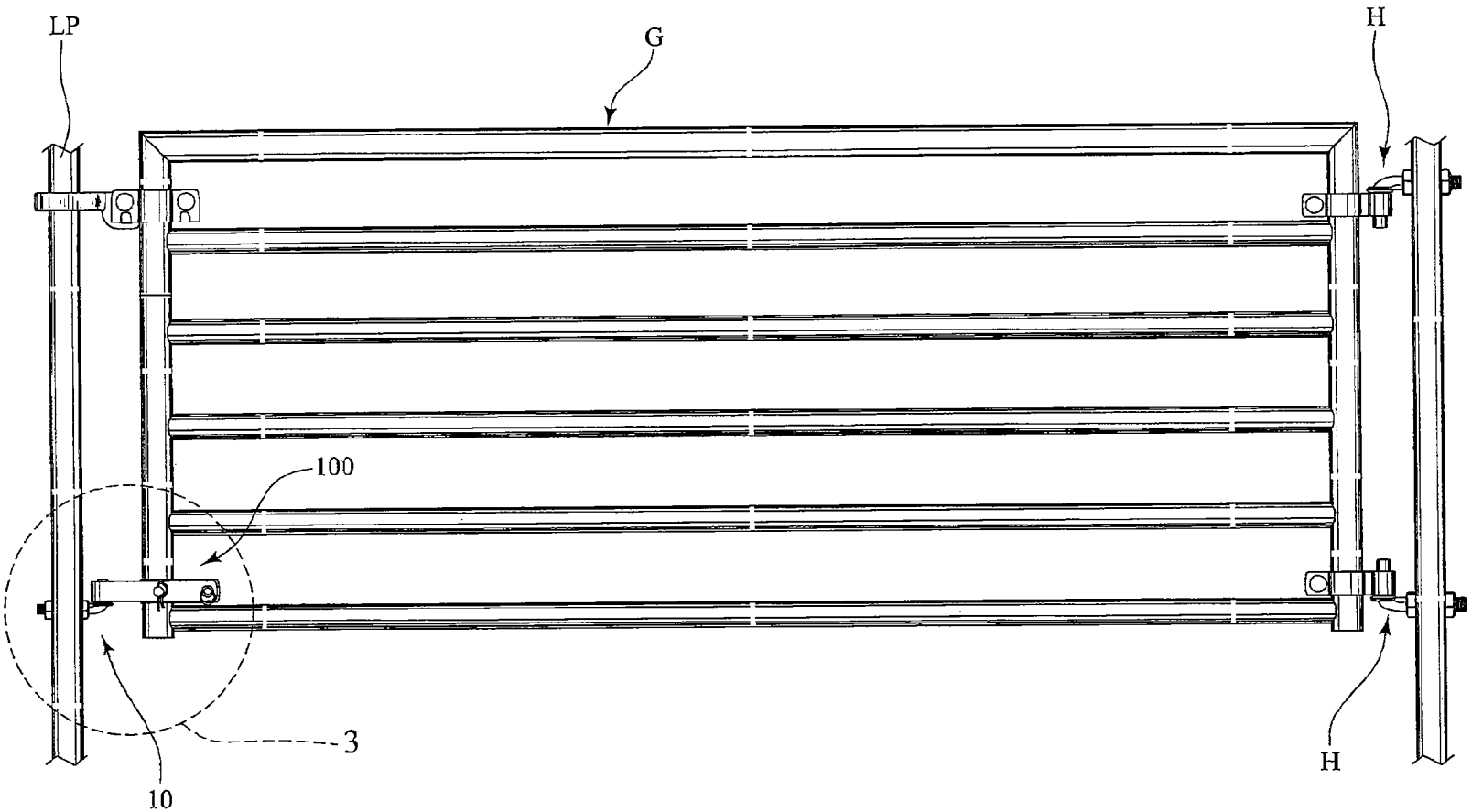
FIG. 4 is a pictorial view of the embodiment of the present invention from FIG. 1 installed in a gate system.

Referring now to FIG. 4, stabilizer assembly 100 is mounted on the end of gate G opposite hinges H. Support member 10 is affixed to latch post LP opposite stabilizer assembly 100. Gate stabilizer 1 operates to reduce sag inducing stress in gate G and hinges H when rotating member 130 is engaged with support member 10 as shown in FIG. 5A by supporting a portion of the weight of gate G. This results in a lessening of the forces on hinges H and the forces within the members of gate G that tend to cause gate sag.

Figure 5C:
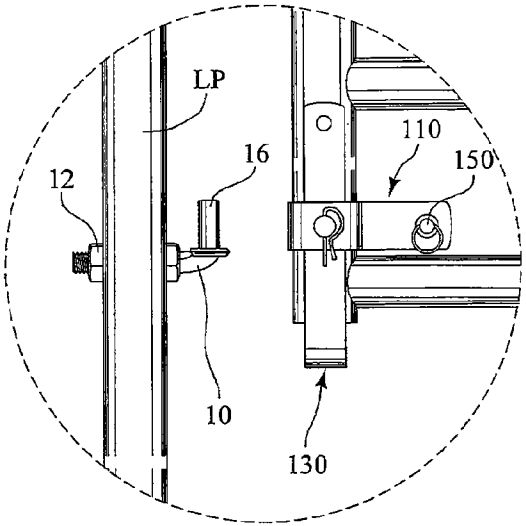
FIGS. 5A, 5B, and 5C are pictorial views of the embodiment of the present invention from FIG. 1 in use.
Figure 5B:
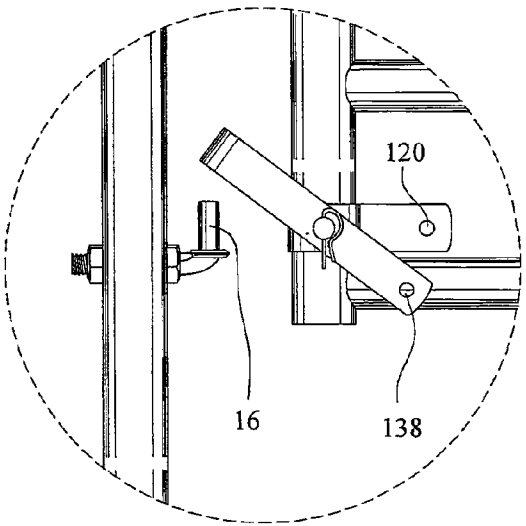
Figure 5A:
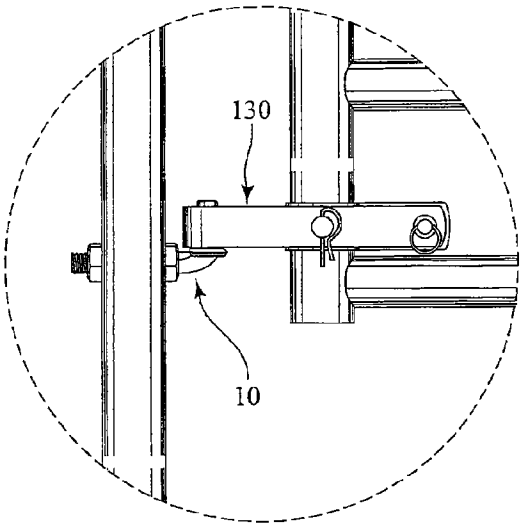

In the illustrated embodiment, stabilizer assembly 100 is located toward the bottom of gate G on gate post GP such that rotating member 130 can be allowed to hang parallel to gate post GP in a disengaged position when it is not engaged with support member 10 as shown in FIG. 5C. This allows rotating member 130 to be out of the way when gate G is opened and closed. This location has the added benefit of increasing the ability of the gate to retain animals by preventing the lower portion of the gate from being pushed outward when rotating member 130 is engaged with support member 10.

In an alternate embodiment, gate post GP could include a through hole that would align with holes 138 and 140 when rotating member is in the disengaged position. This would allow coupling pin 150 to lock rotating member 130 in its disengaged position to prevent it from inadvertently rotating when gate G is opened or closed. This would also provide a place to store coupling pin 150 when gate stabilizer 1 is not engaged. Alternatively, as shown in FIG. 5C, coupling pin 150 can be inserted through coupling apertures 120 and 122 in fixed member 110 when gate stabilizer 1 is not engaged.

In an alternative application, gate stabilizer 1 could be mounted toward the top of gate G to replace conventional latch L. If used in this manner, gate stabilizer 1 would provide the gate latching function in addition to reducing sag-inducing stress by carrying a portion of the weight of gate G unlike conventional latch L.

Gate stabilizer 1 is used to reduce sag-inducing stress in Gate G by affixing stabilizer assembly 100 to gate post GP on the end of gate G opposite hinges H. Support member 10 is then affixed to latch post LP opposite stabilizer assembly 100. Gate stabilizer 1 is then engaged by rotating the engagement end of rotating member 130 up toward gate post GP. Gate G is then moved to its closed position. The engagement end of rotating member 130 is then rotated down to engage support member 10. Support member 10 should be located on latch post LP such that the lower edge of rotating member engages the portion of the L-shape extending toward latch post LP to ensure that the gate stabilizer bears a portion of the weight of gate G. Coupling apertures 138 and 140 in the opposing end of rotating member 130 are then aligned with coupling apertures 120 and 122 in fixed member 110 and coupling pin 150 is passed though coupling apertures 138, 120, 122, and 140 to firmly fix rotating member 130 relative to fixed member 110. Gate stabilizer 1 is disengaged by reversing these steps.

An alternative embodiment of the invention, gate stabilizer 200, is illustrated in FIGS. 6-9. This embodiment utilizes rotating member 230 in place of rotating member 130 and support member 250 in place of L-shaped support member 10. Gate stabilizer 200 additionally includes coupling pin 150 and fixed member 110. In this embodiment, fixed member 110 is affixed to horizontal member HM of gate G, and rotating member 230 rotates in a generally horizontal plane rather than a generally vertical plane as is the case with rotating member 130 of the embodiment illustrated in FIGS. 1-5.

Figure 6A:
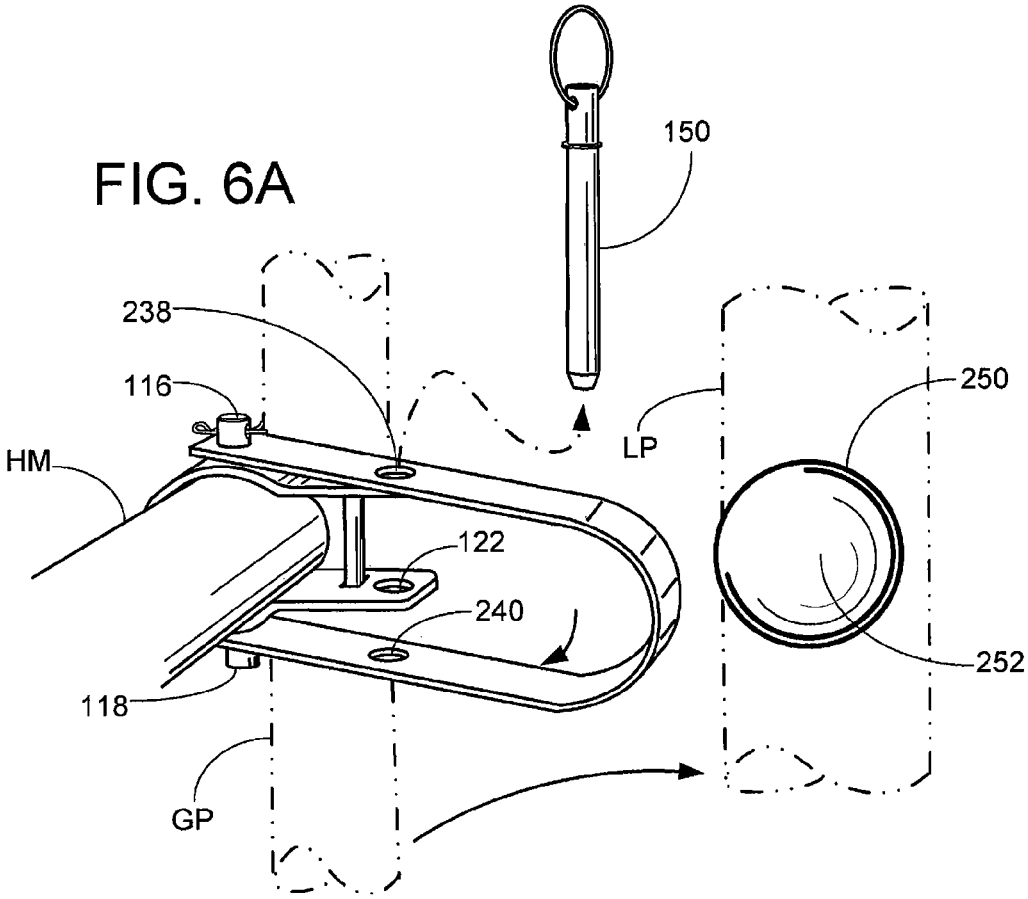
FIGS. 6A and 6B are perspective views of an alternate embodiment of the present invention installed in a gate system.
Figure 6B:
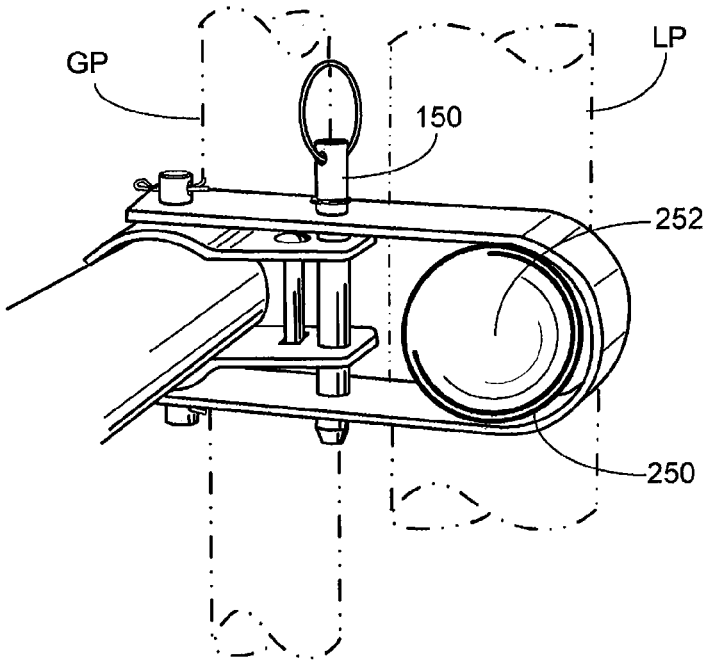

Referring now to FIGS. 6A and 6B, support member 250 comprises a generally ball-shaped member with end portion 252 that is generally hemispheric and opposing end portion 253 (not shown). Support member 250 is preferably adapted to be connected to latch post LP utilizing threaded blind bore 254 (best seen in FIG. 8) that is adapted to engage threaded stud 256 (not shown) that extends from latch post LP. Alternatively, support member 250 could define an aperture allowing support member 250 to be affixed to latch post LP with a lag screw or bolt. Support member 250 could also be attached to latch post using one or more of various other known apparatuses or methods for connecting one article to another including, but not limited to, adhesives, nails, welding, and soldering.

In this embodiment, rotating member 230 is a generally U-shaped member that includes a pair of rotational apertures 232 and 234 located opposite each other toward open end portion 231 of the U-shape of rotating member 230. Rotational apertures 232 and 234 are sized to receive cylindrical projections 116 and 118, allowing rotating member 230 to rotate about cylindrical projections 116 and 118. Closed end portion 236 of U-shaped rotating member 230 is adapted to engage support member 250. In the illustrated embodiment, this adaptation comprises providing closed end portion 236 with a diameter that is complementary to support member 250.

Rotating member 230 further comprises coupling apertures 238 and 240 for receiving coupling pin 150. Coupling apertures are located opposite each other along the opposing side portions of U-shaped rotating member 230 such that coupling apertures 238 and 240 align with coupling apertures in 120 and 122 that are defined in fixed member 110 when rotating member 230 is rotated to engage support member 250. Rotating member 230 can optionally be equipped with shroud 131.

In an alternate embodiment (not shown), rotating member 230 is sized to fit within the open portion of fixed member 110. In such an alternate embodiment, rotating member 230 is adapted to rotate about bolt 112 rather than projections 116 and 118.

Figure 8:
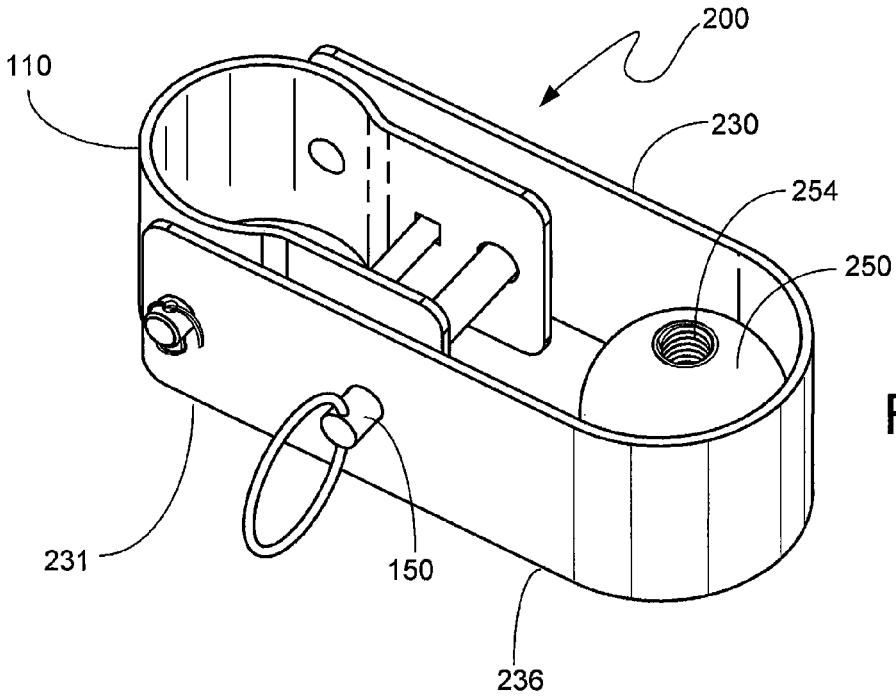
FIG. 8 is perspective view of a portion of the embodiment of the present invention from FIG. 6.
Figure 7:
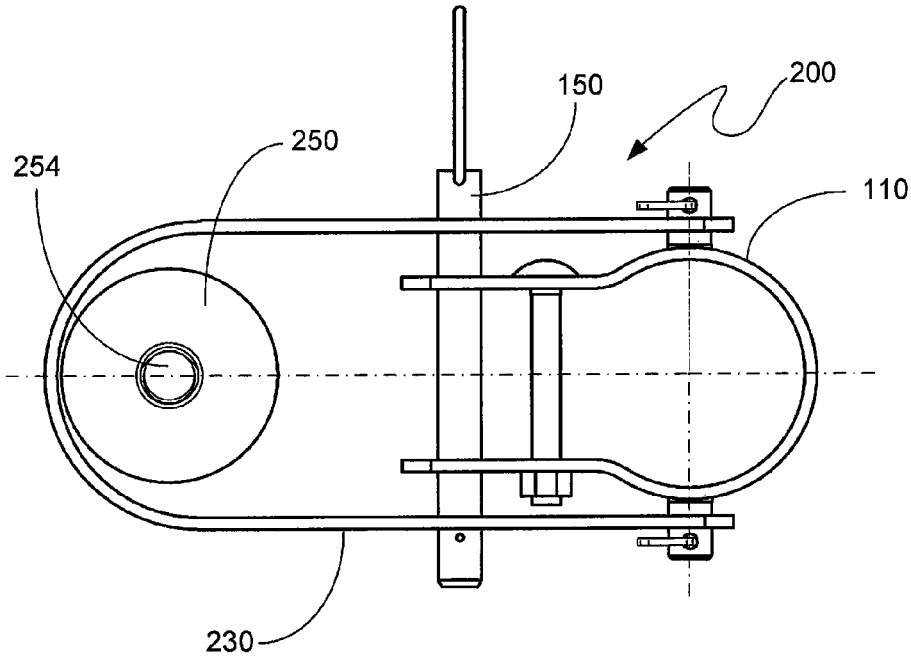
FIG. 7 is a top elevation view of the embodiment of the present invention from FIG. 6.
Figure 9:
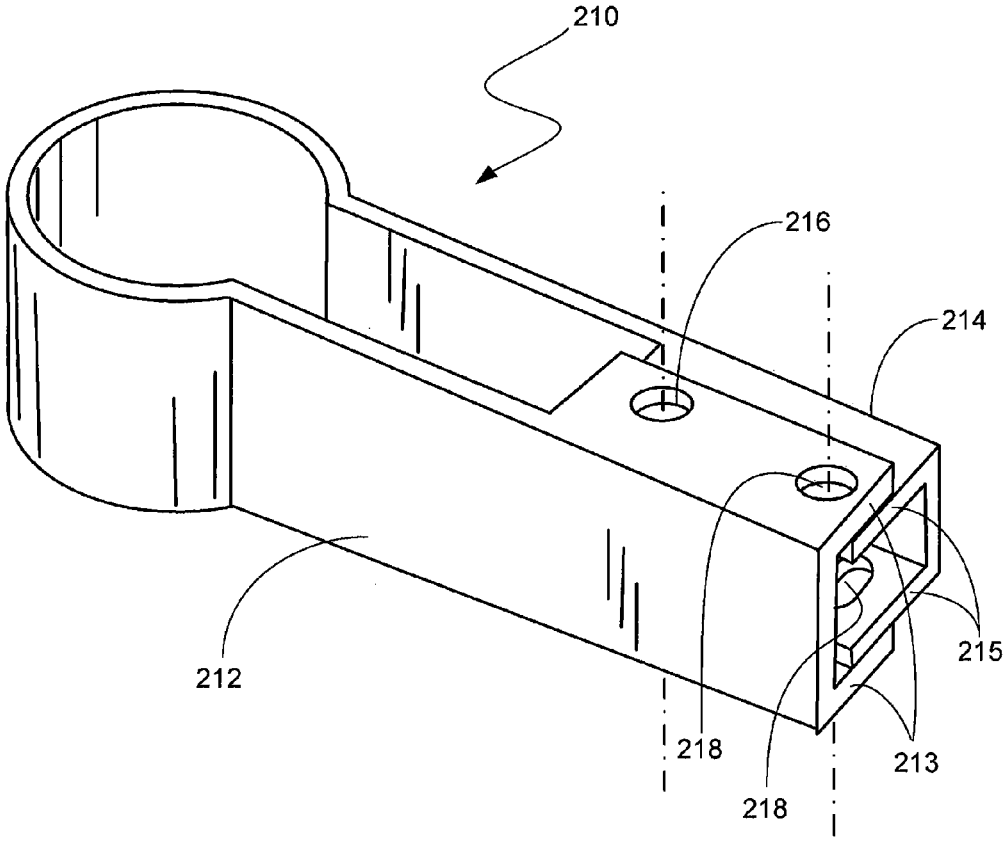
FIG. 9 is a perspective view of another alternate embodiment of the present invention.

Illustrated in FIG. 9 is an alternate embodiment of the fixed member portion of the embodiment pictured in FIGS. 6-8. In this embodiment, fixed member 210 is adapted to be affixed to vertical gate post GP rather than to a horizontal gate member GM. In this embodiment, leg portion 212 includes paired tabs 213 and leg portion 214 includes paired tabs 215. Paired tabs 213 are spaced apart to allow paired tabs 215 to be inserted between paired tabs 213. Each tab 213 and tab 214 define apertures 216 and 218 that align when fixed member 210 is compressed about gate post GP. In a preferred embodiment, apertures 218 defined in paired tabs 215 are elongated slots to facilitate the insertion of locking pin 150. Apertures 216 are sized to receive bolt 112 (not shown) that retains fixed member 210 in a compressed state. In this embodiment, rotating member 230 is adapted to rotate about bolt 112. To facilitate said rotation, washers (not shown) can be provided. Apertures 218 also align when fixed member 210 is compressed about gate post GP. Apertures 218 are sized to receive coupling pin 150 to enable the locking of rotating member 230.

When the embodiment illustrated in FIGS. 6-9 is installed in the fence system, support member 250 is located on latch post LP such that rotating member 230 will initially contact the upper half of support member 250. Thus, as rotating member 230 is rotated to fully engage support member 250, rotating member 230 will slide up hemispherical end 252 of support member 250 to ensure that a portion of the weight of gate G is born by stabilizer assembly 200 and support member 250.

Figure 10:
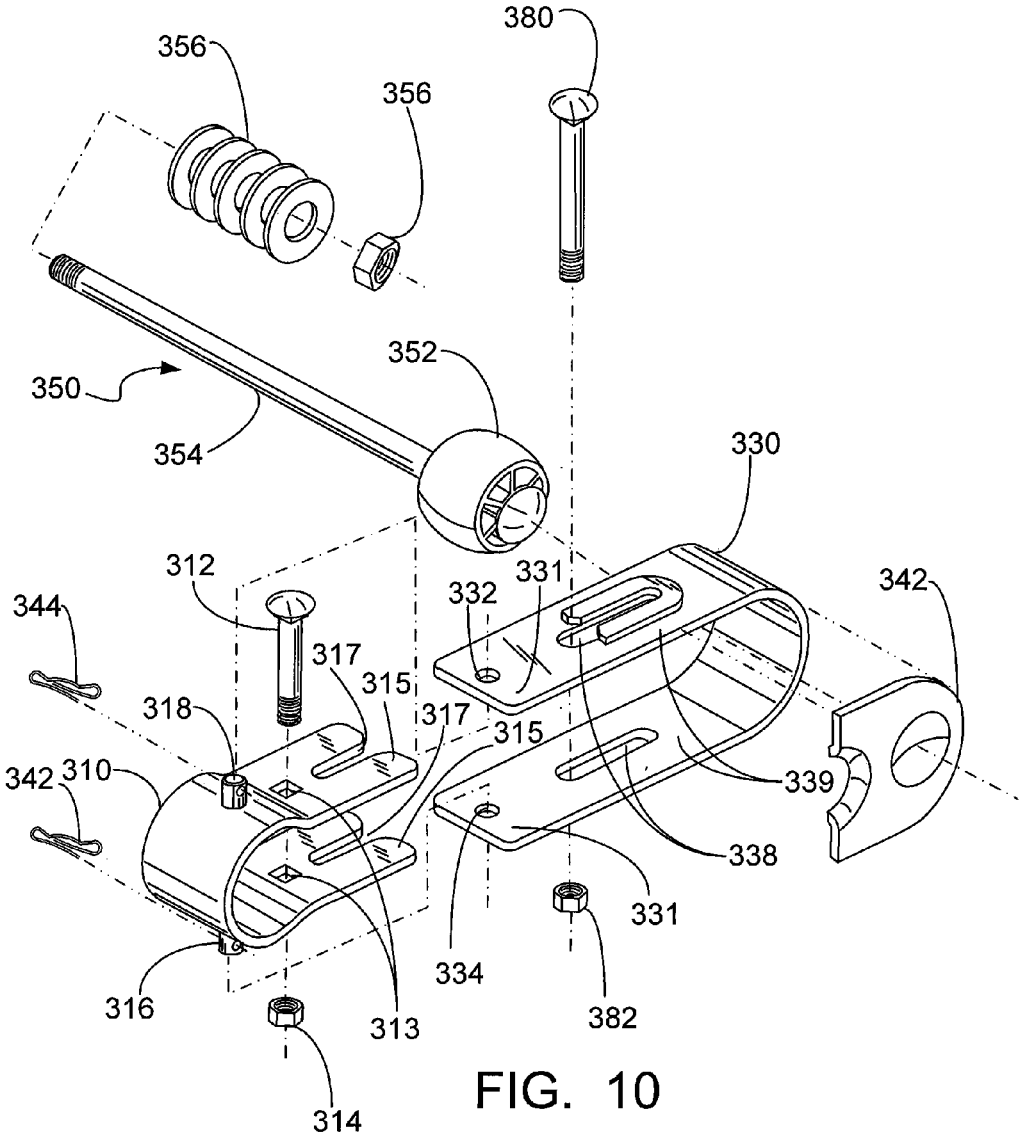
FIG. 10 is an exploded perspective view of an alternate embodiment of the present invention.
Figure 11:
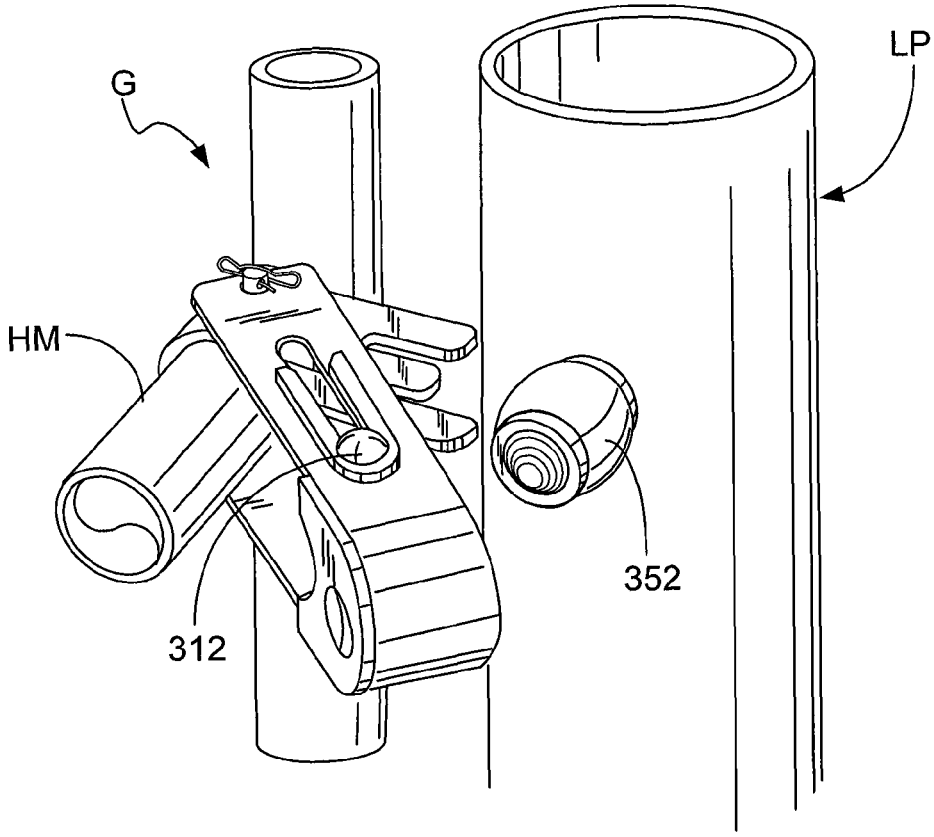
FIG. 11 is a perspective view of the embodiment of the present invention from FIG. 10 showing the embodiment installed in a gate system and in its unlatched position.
Figure 12:
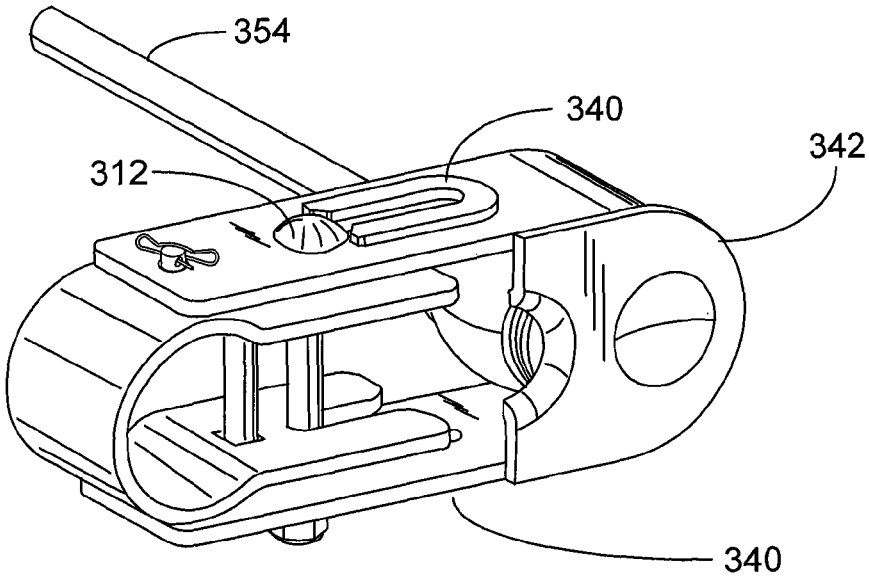
FIG. 12 is a perspective view of the embodiment of the present invention from FIG. 10 showing the embodiment in its latched position.

Illustrated in FIGS. 10-12 is an alternate embodiment of the invention, gate stabilizer 300. Generally U-shaped fixed member 310 is affixed to horizontal member HM of gate G by compressing fixed member 310 around horizontal member HM using bolt 312 and nut 314, wherein bolt 312 passes through opposing apertures 313 defined in fixed member 310. Bolt 312 is preferably a carriage bolt and apertures 313 are preferably square and sized to receive the square shoulder portion of carriage bolt 312 regardless of the direction from which bolt 312 is inserted. Defined in the opposing open end portions 315 of fixed member 310 are opposing latching keyways 317. Fixed member 310 also includes cylindrical projections 316 and 318.

Generally U-shaped rotating member 330 includes opposing rotational apertures 332 and 334 defined in the opposing open end portions 331 of rotating member 330. Rotational apertures 332 and 334 are sized to receive cylindrical projections 316 and 318 and to allow rotating member 330 to rotate about cylindrical projections 316 and 318. Rotating member 330 is held in place with spring-type cotter pins 342 and 344 that are inserted though apertures defined in cylindrical projections 316 and 318.

Rotating member 330 further includes opposing latching slots 338 defined in central portion 339 of rotating member 330. Slots 338 have a width sized to receive latching bolt 380. On the external surface of rotating member 330, each of latching slots 338 is partially surrounded by raised, U-shaped shoulder 340. Shoulder 340 may be formed by the addition of a second layer of material to rotating member 330 as illustrated in FIGS. 10-12 or by drawing or stamping the material forming rotating member 330. Rotating member 330 may also include grip 342 affixed to closed end portion of rotating member 330 to prevent rotating member 330 from over-rotating when it is rotated to its closed position and to provide a convenient grip for use when rotating member 330 is rotated.

In use, rotating member 330 is fixed in its latched position by rotating it to the point where latching slots 338 align with latching keyways 317 defined in fixed member 310. Latching bolt 380 is then moved toward gate G and into latching keyways 317 to prevent rotating member 330 from rotating. The open end portion of latching keyways 317 may be chamfered or rounded to assist in guiding latching bolt 380 into latching keyways 317. Latching bolt 380 is fixed in a latched position by shoulder 340 as shown in FIG. 12. To unlatch gate stabilizer 300, latching bolt 380 is pushed upward to allow the head portion of latching bolt 380 to clear shoulder 340 and moved away from gate G until latching bolt 380 is no longer within latching keyways 317.

Gate stabilizer 300 also includes support member 350. Support member 350 includes hemispherical, generally ball-shaped member 352 affixed to an end portion of shaft 354. Shaft 354 is preferably threaded at the opposing end and has a length sufficiently greater than the diameter of latch post LP to allow support member 350 be affixed to latch post LP using nut 358. Washers 356 can be used to adapt support member 350 to posts of varying diameters and can be used between ball-shaped member 352 and latch post LP to space ball-shaped member 352 away from latch post LP at the proper distance to allow rotating member 330 to engage ball-shaped member 352 in rotating member 330 is rotated to its latched position. In an alternative embodiment (not shown) for use with a wood latch post LP, support member 350 could utilize a shaft with a pointed thread like a lag bolt to allow support member 350 to be screwed directly into latch post LP.

To use gate stabilizer 300, fixed member 310 is attached to horizontal member HM of gate G. Rotating member 330 is then rotatably attached to fixed member 310 by inserting cylindrical projections 316 and 318 through rotational apertures 332 and 334 and securing rotating member 330 with cotter pins 342 and 344. Support member 350 is located on latch post LP such that rotating member 330 will initially contact the upper half of ball-shaped member 352. Thus, as rotating member 330 is rotated to fully engage ball-shaped member 352, rotating member 330 will slide up the circumference of ball-shaped member 352 to ensure that a portion of the weight of gate G is born by gate stabilizer 300 and support member 350.

The fixed member of gate stabilizer 300 can also be adapted to be affixed to vertical gate post in a similar manner to the embodiment of fixed member 210 illustrated in FIG. 9. In such an adaptation the end portions of paired tabs 213 and 215 would be formed to define latching keyways for receiving latching bolt 380 similar to latching keyways 317 defined in fixed member 310.

While the above describes the illustrated embodiments, those skilled in the art may appreciate that certain modifications may be made to the apparatus and methodology herein disclosed, without departing from the scope and spirit of the invention. For example, in the embodiment illustrated in FIGS. 1-5, one or both of fixed member 110 and rotating member 130 could be a flat member instead of a U-shaped member. In such a configuration, shroud 131 could be mounted to either rotating member 130 or fixed member 110 as required to shield the end of coupling pin 150. Similarly, in the embodiments illustrated in FIGS. 6-9, one or both of fixed member 110 and rotating member 230 could be a flat member instead of a U-shaped member. If rotating member 23 were a flat member, support member 25 would be adapted accordingly to receive a flat member. Also, coupling pin 150 could be a padlock instead of a cylindrical device. Thus, it should be understood that the invention may be adapted to numerous rearrangements, modifications, and alterations and that all such are intended to be within the scope of the appended claims.

I claim:

1. A gate stabilizing device comprising:

a support member;

a U-shaped fixed member having a closed end, an open end, a pair of sides, and a pair of opposing latching keyways defined in the open opposing end portions of the U-shaped fixed; and a U-shaped rotating member having a closed end, an open end, and a pair of sides rotationally connected to said U-shaped fixed member wherein the closed end of said U-shaped rotating member is adapted to engage said support member and the sides of the U-shaped rotating member define opposing latching slots such that said latching slots align with said latching keyways when said U-shaped rotating member is engaged with said support member;

a latching bolt, said latching bolt having a shaft sized to pass through said latching slots and said latching keyways and said latching bolt having a length sufficient to simultaneously extend through each of said latching slots; wherein the support member has a first end portion that is generally hemispherical;

the U-shaped rotating member rotates in a horizontal plane and the closed end of the U-shape has a diameter that is complementary to the diameter of the generally hemispherical end portion of the support member; and the support member is affixed to a latching post and the U-shaped fixed member is affixed to a gate such that when the gate is in its closed position the closed end of the U-shaped rotating member engages the generally hemispherical end portion of the support member such that the gate stabilizing device bears a portion of the gate's weight.

2. The gate stabilizing device of claim 1 wherein the latching slots defined in the U-shaped rotating member are partially surrounded by a shoulder.

3. The gate stabilizing device of claim 2 further comprising a grip affixed to an edge portion of the U-shaped rotating member adjacent to and extending beyond the closed end of the U-shaped portion.

4. The gate stabilizing device of claim 2 wherein the fixed member is affixed to a horizontal member of the gate.

5. The gate stabilizing device of claim 2 wherein the fixed member is affixed to a vertical member of the gate.

6. A fencing system comprising:

a gate, said gate having a hinge end portion, said hinge end portion including at least one hinge and a latching end portion;

a hinge post to which said at least one hinge is connected;

a latching post, a gate stabilizer, said gate stabilizer including a support member connected to said latching post;

a U-shaped fixed member having a closed end, an open end, and a pair of sides connected to the latching end portion of said gate;

a U-shaped rotating member having a closed end, an open end, and a pair of sides rotationally connected to the U-shaped fixed member wherein the closed end of said U-shaped rotating member is adapted to engage said support member, the sides of the U-shaped rotating member define opposing latching slots, and the open opposing end portions of the U-shaped fixed member define opposing latching keyways such that the latching slots in said U-shaped rotating member align with the latching keyways in said U-shaped fixed member when said U-shaped rotating member is engaged with said support member; and a latching bolt, said latching bolt having a shaft sized to pass through said latching slots and said latching keyways and said latching bolt having a length sufficient to simultaneously extend through each of said latching slots; wherein the support member has a first end portion that is generally hemispherical;

the U-shaped rotating member rotates in a horizontal plane and the closed end of the U-shape has a diameter that is complementary to the diameter of the generally hemispherical end portion of the support member; and the support member is affixed to a latching post in a fence system and the U-shaped fixed member is affixed to a gate in the fence system such that when the gate is in its closed position the closed end of the U-shaped rotating member engages the generally hemispherical end portion of the support member such that the gate stabilizer bears a portion of the gate's weight.

7. The fencing system of claim 6 wherein the gate stabilizer further comprises a shoulder partially surrounding each of the latching slots defined in the U-shaped rotating member.

8. The fencing system of claim 7 further wherein the gate stabilizer further comprises a grip affixed to an edge portion of the U-shaped rotating member adjacent to and extending beyond the closed end of the U-shaped portion.

9. The gate stabilizer of claim 7 wherein the fixed member is affixed to a horizontal member of the gate.

10. The gate stabilizer of claim 7 wherein the fixed member is affixed to a vertical member of the gate.

* * * * *